United States Patent [19]

Abe et al.

[11] Patent Number: 4,673,349

[45] Date of Patent: Jun. 16, 1987

[54] HIGH TEMPERATURE SURFACE COMBUSTION BURNER

[75] Inventors: Fumio Abe; Hiroshi Hasegawa; Tadashi Fujita, all of Nagoya; Makoto Maeda, Ichinomiya, all of Japan

[73] Assignee: NGK Insulators, Ltd., Japan

[21] Appl. No.: 809,006

[22] Filed: Dec. 16, 1985

[30] Foreign Application Priority Data

Dec. 20, 1984 [JP] Japan ..... 59-193326[U]
Oct. 4, 1985 [JP] Japan ..... 60-152083[U]

[51] Int. Cl.[4] ..... F23D 14/12

[52] U.S. Cl. ..... 431/328; 431/170; 126/92 AC

[58] Field of Search ..... 431/7, 170, 328; 126/92 R, 92 AC

[56] References Cited

U.S. PATENT DOCUMENTS 3,695,818 10/1972 Mizutani ..... 431/328
3,810,732 5/1974 Koch ..... 431/7
4,504,218 3/1985 Mihara et al. ..... 431/328 X

FOREIGN PATENT DOCUMENTS 82208 6/1980 Japan ..... 431/328

*Primary Examiner*—Margaret A. Focarino
*Attorney, Agent, or Firm*—Parkhurst & Oliff

[57] ABSTRACT

A high temperature surface combustion burner, comprises a burner head having an air fuel mixed gas supply inlet, a burner plate secured to said burner head, wherein the burner plate is made of a ceramic porous body having more than 30% by volume of pores of 25 to 500 μm in mean pore diameter; and a plurality of throughholes having a 0.05 to 5.0 mm diameter and provided in said burner plate at intervals of 2 to 30 mm and substantially vertically extending with respect to the combustion surface.

Another surface combustion burner comprises a burner head having an air fuel mixed gas supply inlet, a burner element secured to said burner head, said burner element consisting of a ceramic porous body having pores sufficiently communicated from its inside to its outside for diffusing an air fuel mixed gas, wherein said ceramic porous body has 75 to 95% by volume in total of communicated pores of 0.5 to 5.0 mm in mean pore diameter; and a plurality of throughholes each having a hydraulic diameter of 0.05–5.0 mm and substantially vertically extending with respect to the combustion surface and provided in said burner element at intervals of 2 to 30 mm.

5 Claims, 3 Drawing Figures

HIGH TEMPERATURE SURFACE COMBUSTION BURNER

BACKGROUND OF THE INVENTION

1. Field of the Invention

This invention relates to a high temperature surface combustion burner having a uniform surface combustion temperature and strong thermal shock resistance used for industrial furnaces and the like.

This invention further relates to a surface combustion burner having a wide combustion range and excellent durability.

2. Related Art Statements

Hitherto, as surface combustion burners, use has widely been made of a non-permeable ceramic plate provided with a number of throughholes, but said burner cannot be used in the field where uniform heating is required on the surface of ceramic plate, because the combustion takes place on the surface of the throughholes. As a result, the surface temperature of an intermediate portion between the throughholes is low, and it has further such shortcomings that the ceramic plate is liable to breakdown by thermal shock at the time of igniting the burner, because it takes time to make the surface of the ceramic plate, after ignition, become red hot. Thus, since thermal conductivity of the ceramic plate is high, when the surface combustion temperature is raised to more than 900° C., the temperature in the vicinity of throughholes on the rear of the ceramic plate is raised to ignite fuel gas and to incur the danger of back fire, that notwithstanding the desirable surface temperature of more than 900° C. in order to improve radiation efficiency, the surface temperature should be suppressed to less than about 900° C.

As shown in Japanese Patent Laid-open No. 56-130,524, there is partially used a surface combustion burner for burning fuel gas on the surface of a metal fiber or ceramic fiber, but this surface combustion burner is advantageous because of its short amount of time between ignition to the red heat condition and easy processing however, it is disadvantageous for obtaining large radiation efficiency by raising the surface temperature owing to small corrosion resistance at high temperature.

On the other hand, as a prior surface combustion burner, a burner comprising a non-permeable ceramic plate provided with a number of throughholes is widely used, but in this type of burner, the combination is carried out on the surface of the throughholes only, so that the temperature distribution between portions where no throughholes exist, tends to be non-uniform, and the thermal conductivity of the ceramic plate is high, so that the temperature in the vicinity of the throughholes on the surface of the ceramic plate is raised to result in back fire, and in case of accelerating the injection speed of a mixed gas, a blow-off phenomenon is liable to occur, so that a high intensity combustion cannot be attained.

On the other hand, as shown in Japanese Utility Model Laid-open No. 60-6,933, a surface combustion burner with the use of a ceramic porous body having permeability has been known, which has a smaller problem of back fire due to small thermal conductivity, but this burner has such disadvantages that soot and dust formed from combustion clog the burner after operation for a long time to lower its permeability. Thus, the pressure loss rises, and combustion becomes non-uniform, and particularly, when using fuel such as coke oven gas containing more than 5 mg/Nm$^3$ of soot and dust in fuel gas, LD gas, blast furnace gas, coal gasification gas and the like, the burner plate is clogged by soot and dust during combustion, so that this burner disadvantageously has a durability of only several hundred hours.

SUMMARY OF THE INVENTION

An object of the present invention is to obviate the above-described shortcomings of the prior art surface combustion burners and to provide a high temperature surface combustion burner which can achieve a uniformly high surface temperature such as more than 900° C., is durable against a high thermal shock, and is ready to be heated to a red hot condition immediately after ignition.

Another object of the invention is to obviate the above shortcomings of the prior surface combustion burner and to provide a surface combustion burner which can stably continue the combustion within the wide load range without causing any blow-off or back fire, and also continue the combustion for a period of time without clogging a burner element by soot and dust contained in fuel gas or combustion air.

The invention relates to a high temperature surface combustion burner which comprises a burner head having an air fuel mixed gas supply inlet, burner plate secured to said burner head, said burner plate consisting of a ceramic porous body having pores sufficiently communicated from inside to outside for diffusing an air fuel mixed gas, wherein the burner plate is made of a ceramic porous body having more than 30% by volume of pores of 25 to 500$\mu$ in mean pore diameter; and a plurality of throughholes each having a hydraulic diameter of 0.05–5.0 mm, and substantially vertically extending with respect to the combustion surface and provided in said burner element at intervals of 2 to 30 mm.

Another object of the present invention is to provide a surface combustion burner which comprises; a burner head having an air fuel mixed gas supply inlet, a burner element secured to said burner head, said burner element consisting of a ceramic porous body having pores sufficiently communicated from the inside to outside for diffusing an air fuel mixed gas, wherein said ceramic porous body has 75 to 95% by volume in total of communicated pores of 0.5 to 5.0 mm in mean pore diameter; and a plurality of throughholes each having a hydraulic diameter of 0.05–5.0 mm and substantially vertically extending with respect to the combustion surface and provided in said burner element at intervals of 2 to 30 mm.

Figure 1:
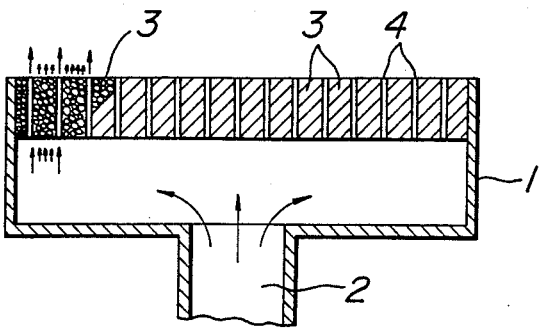
FIG. 1 is a cross-sectional view showing a first embodiment of the invention.

In the drawings, 1 is a burner head, 2 is an air fuel mixed gas supply inlet, 3 is a burner plate, 4 is a throughhole, 5 is a burner element, 6 is a porous ceramic body, 7 is a throughhole.

DETAILED DESCRIPTION OF THE PREFERRED EMBODIMENTS

The preferred embodiment of the invention will be explained in detail.

In the first embodiment shown in FIG. 1, 1 is a burner head provided with an air fuel mixed gas supply inlet 2, and 3 is a burner plate fixed to an opening of the burner head 1. The burner plate 3 is made of a ceramic porous body such as an $Al_2O_3$ group, $ZrO_2$ group, feldspar group and the like having more than 30% by volume of pores of 25 to 500 μm in mean pore diameter provided with a number of throughholes 4 having a hydraulic diameter of 0.05 to 5.0 mm at intervals of 2 to 30 mm, which, for example, can be obtained by mixing these ceramic powders with glaze and an inorganic binder, molding the mixture, firing and sintering the molded article at a temperature of more than 1,000° C. Further, if 2 to 50% by weight of a heat-resisting inorganic fiber such as a $SiO_2$-$Al_2O_3$ ceramic fiber, an $Al_2O_3$ ceramic fiber and the like is added to the raw material, the strength of the ceramic porous body is improved and the thermal shock resistance becomes excellent. The reason why the mean pore diameter of the ceramic porous body is limited to 25 to 500μ is because less than 25 μm causes great pressure drop of fuel gas passed through the ceramic porous body and more than 500μ lowers their strength. The reason why the ratio of the pore occupied in the ceramic porous body is more than 30% by volume is because less than 30% by volume makes the thermal conductivity large so as to incur the danger of back fire in the same manner as in the prior Schwank burner. The method of providing throughholes 4 in the ceramic porous body may be attained by molding with a mold at the time of molding or by providing with intervals by a drill after molding. The reason why the hydraulic diameter of the throughhole 4 is made 0.05 to 5.0 mm is because less than 0.05 mm can hardly generate main combustion at the throughhole portion and the combustion becomes incomplete, and more than 5.0 mm generates a blow through phenomenon of combustion flames and the combustion becomes non-uniform. The reason why the interval of the throughhole 4 is made 2 to 30 mm is because less than 2 mm lowers the strength of the burner plane and more than 30 mm cannot make surface temperature uniform. Further, less than 2% of the heat-resisting inorganic fiber is insufficient in addition effect and more than 50% thereof lowers strength, so that the range of 2 to 50% is preferable.

Figure 2:
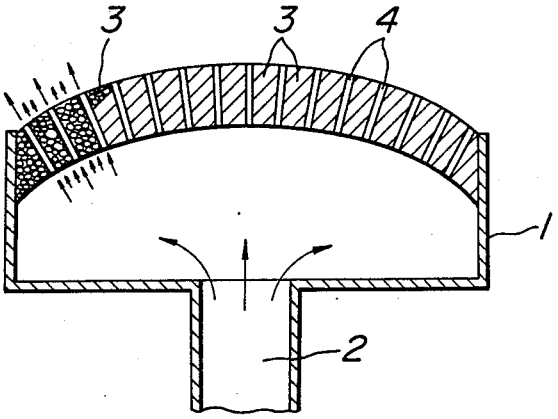
FIG. 2 is a cross-sectional view showing a second embodiment of the invention.

In the second embodiment shown in FIG. 2, the burner plate 3 is a convexly curved plate and is the same as the first embodiment shown in FIG. 1, except that a combustion area is increased and the high intensity combustion is obtained and that the heat transfer direction of heat generated is different. A concavely curved burner plate 3 is not shown, but the same theory is applied to such a plate.

In the thus constructed burner, when the fuel gas is supplied to the inside of a burner head 1, the fuel gas is passed through and combusted on the surface of a burner plate 3 through a number of throughholes 4 having a hydraulic diameter of 0.05 to 5.0 mm, preferably 0.5 to 2.0 mm, provided in the burner plate 3 at intervals in the same manner as in the prior Schwank burner, but the burner plate 3 of the present invention is a ceramic porous body having more than 30% by volume of pores of 25 to 500μ in mean pore diameter, so that the fuel gas exudes and combusts even at the intermediate portion of the throughhole 4 through these pores, and a uniform surface temperature can be obtained. Further, the burner plate 3 of the present invention is porous and has small inner thermal conductivity, so that there is no possibility of back firing, even if the surface temperature is raised to 900 ° to 1,200° C., and as a result, stable combustion can be obtained by making the surface combustion intensity large and the surface of the burner plate 3 can be made red hot immediately after ignition.

In order to confirm the properties of the high temperature surface combustion burner according to the invention, four kinds of high temperature surface combustion burner, as shown in the following Table 1, were prepared, a propane gas fuel was combusted by the thus prepared burners together with a Schwank burner available on the market, and the surface temperature and combustion conditions were observed. The results are shown in Tables 2, 3 and 4. As shown in Tables 2, 3 and 4, the stable combustion was continued with high surface intensity combustion such as 6,000,000 cal/m²·Hr. The ignition and the extinction were repeated every 1,000 times, but no cracks were generated in the surface combustion burner of the present invention.

TABLE 1

| No. | Mean pore diameter (μ) | Porosity (%) | Fiber addition amount (%) | Throughhole diameter (mmϕ) | Interval of throughhole (mm) | Material | Whole configuration |
|---|---|---|---|---|---|---|---|
| 1 | 250 | 32 | 0 | 1 | 5 | Porcelain | 200 × 200 × 20 mm |
| 2 | 250 | 33 | 5 | 1 | 5 | Porcelain | 200 × 200 × 20 mm |
| 3 | 40 | 38 | 0 | 1 | 5 | Alumina | 200 × 200 × 20 mm |
| 4 | 40 | 32 | 0 | 1 | 5 | Porcelain | 200 × 200 × 20 mm |

TABLE 2

| | Surface temperature | | | | Combustion condition | |
|---|---|---|---|---|---|---|
| | Highest point (°C.) | Lowest point (°C.) | Pressure drop (mmAq) | Radiation efficiency (%) | Surface combustion load | Excess air ratio |
| Schwank burner | 950 | 850 | 100 | 30 | $12 \times 10^4$ Kcal/m² · Hr | 1.0 |
| No. 1 ~ No. 4 | 905 | 895 | 20 | 50 | $12 \times 10^4$ Kcal/m² · Hr | 1.0 |
| | 935 | 925 | 20 | 50 | $14 \times 10^4$ Kcal/m² · Hr | 1.0 |
| | 1,010 | 990 | 20 | 50 | $20 \times 10^4$ Kcal/m² · Hr | 1.0 |
| | 1,220 | 1,180 | 20 | 50 | $60 \times 10^4$ Kcal/m² · Hr | 1.0 |

TABLE 3

| Surface combustion load | $14 \times 10^4$ Kcal/m$^2$ · Hr | $20 \times 10^4$ Kcal/m$^2$ · Hr | $60 \times 10^4$ Kcal/m$^2$ · Hr |
|---|---|---|---|
| No. 1~No. 4 | Stable combustion | Stable combustion | Stable combustion |
| Schwank burner | Back fire | — | — |

TABLE 4

| Surface combustion load | $200 \times 10^4$ Kcal/m$^2$ · Hr | $600 \times 10^4$ Kcal/m$^2$ · Hr |
|---|---|---|
| No. 1~No. 4 | Stable combustion | Stable combustion |
| Schwank burner | — | — |

As apparent from the above explanation, the invention comprises a ceramic porous body having more than 30% by volume of pores of 25 to 500$\mu$ in mean pore diameter and a number of throughholes each having a hydraulic diameter of 0.05–5.0 mm and substantially vertically extending with respect to the combustion surface and provided in said burner plate at intervals of 2 to 30 mm, wherein the gas fuel exuded through these pores combusts even at the intermediate portion of the throughhole, so that the surface temperature is made uniform and even if the surface temperature is raised to more than 900° C., stable combustion can be carried out without any danger of back fire. The high temperature surface combustion burner according to the invention is short in rising time from ignition to the red hot condition and is excellent in thermal shock resistance, so that the invention is extremely useful in practical value as a solution of disadvantages inherent to the prior surface combustion burner.

Figure 3:
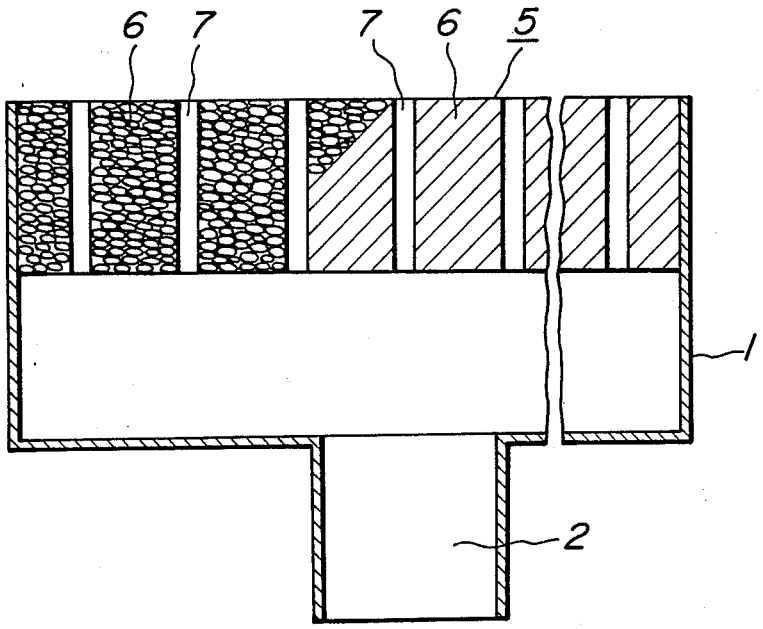
FIG. 3 is a front view, partly broken, showing another emboddiment of the invention.

FIG. 3 shows another embodiment of the present invention. In FIG. 3, referance numeral 1 is a burner head provided with a mixed gas supply inlet 2 for supplying an air fuel mixed gas, and 5 is a burner element fixed to an opening portion of the burner head 1. Said burner element 5 is made by providing a number of throughholes 7 having a uniform diameter in a ceramic porous body 6 having pores sufficiently communicated from its inside to its outside for diffusing the mixed gas at intervals. This ceramic porous body 6 is obtained, for example, by foaming soft polyurethane form, removing a foamed film, impregnating in a slurry of ceramic powder such as cordierite, alumina, mullite, SiC and the like, removing the excessive slurry, drying and firing, in which a mean pore diameter of the communicated pore is 0.5 to 5.0 mm and its total volume is 75 to 95% by volume. If the mean pore diameter of the ceramic porous body is less than 0.5 mm, the clogging is liable to generate, while if it exceeds 5.0 mm, the strength is lowered. Further, if the total volume of the pores is less than 75% by volume, a low thermal conductivity expected by the invention cannot be obtained, while the total volume exceeds 95% by volume, there is the possibility of lowering the strength. Further, the number of throughholes 7 provided in the burner element 5 at suitable intervals have a hydraulic diameter, that is, the value of (throughhole cross-sectional area×4/throughhole inner peripheral length) of 0.5 to 5.0 mm and the interval of 2 to 30 mm. Here, if the hydraulic diameter of the throughhole 7 is less than 0.05 mm, the burner element is clogged by dirt and dust contained in fuel gas or combustion air so that no stable combustion is obtained. On the other hand, if the hydraulic diameter exceeds 5.0 mm, the strength of the burner element is lowered or the combustion flame flow through phenomenon is liable to occur. When the interval of the throughhole 7 is less than 2 mm, the strength of the burner element is lowered, and when it exceeds 30 mm, the combustion on the surface of the burner head becomes non-uniform and the burner element is liable to be clogged by soot and dust contained in fuel gas or combustion air. Further, the relation between a diameter (a) of the throughhole 7 and a diameter (d) of the pore of the ceramic body 6 is preferably $a \geqq 2d$ for high intensity combustion.

When the air fuel mixed gas for combustion is supplied to the thus constructed burner from a mixed gas supply inlet 2, the mixed gas is injected from a number of througholes 7 provided in a burner element 5 fixed to an opening of a burner head 1 and burns, and since the burner element 5 consists of a ceramic porous body having pores sufficiently communicated from its inside to its outside for diffusing the mixed gas, a large amount of the mixed gas is injected from the surface of the burner element 5 between the throughholes 7 and burns. In the surface combustion burner according to the invention, the throughholes 7 have a uniform bore shape, so that main combustion is carried out at the portion of this throughhole 7 and the high intensity of combustion becomes possible, while the soot and dust in air fuel mixed gas for combustion gas through said throughholes, so that the stable combustion is possible without any clogging. Whereby, the intermediate portion between the throughholes 7 of the burner element becomes red hot, and a large amount of mixed gas is burnt at this intermediate portion, so that a stable continuous flame is formed by a long flame at the peripheral portion of the throughhole 7 and a short flame at the intermediate portion, and it becomes possible to uniformalize the surface combustion temperature. The burner element of the invention further has large porosity and considerably low thermal conductivity, so that there is no possibility of causing any back fire. The surface combustion burner of the invention is further extremely small in pressure loss of the burner element, and extremely small in increase of pressure loss in operation for a long period of time. In order to confirm the properties of the surface combustion burner according to the invention as described above, three kinds of surface combustion burners were formed as shown in No. 1 to No. 3 of Tables 5 and 6, and a combustion test was conducted together with the surface combustion burner as a comparative example shown in No. 4. As shown in each Table, the surface combustion burner of the invention has an extremely wide combustion load range, is low in pressure loss and small in time change.

TABLE 5

| No. | Mean pore diameter (mm) | Throughhole Hydraulic diameter (mmϕ) | Throughhole Interval (mm) | Porosity (%) | Material | Stable combustion range Back fire limit~Lift limit |
|---|---|---|---|---|---|---|
| 1 | 0.5 | 0.5 | 2.0 | 75 | Cordierite | 100,000 Kcal/m$^2$ · Hr~4,000,000 Kcal/m$^2$ · Hr |

TABLE 5-continued

| No. | Mean pore diameter (mm) | Throughhole Hydraulic diameter (mmϕ) | Throughhole Inter-val (mm) | Porosity (%) | Material | Stable combustion range Back fire limit ~ Lift limit |
|---|---|---|---|---|---|---|
| 2 | 0.5 | 2.0 | 5.0 | 80 | Cordierite | 100,000 Kcal/m$^2$ · Hr ~ 6,000,000 Kcal/m$^2$ · Hr |
| 3 | 5 | 5 | 10 | 90 | Cordierite | 100,000 Kcal/m$^2$ · Hr ~ 4,000,000 Kcal/m$^2$ · Hr |
| 4 | 0.5 | none | — | 80 | Cordierite | 100,000 Kcal/m$^2$ · Hr ~ 1,000,000 Kcal/m$^2$ · Hr |

(Combustion of LNG-13A as fuel at an excess air ratio of 1.1)

TABLE 6

| No. | Mean pore diameter (mm) | Throughhole Hydraulic diameter (mmϕ) | Throughhole Inter-val (mm) | Porosity (%) | Material | Pressure drop (mmAq) Fresh | 100 Hr | 1,000 Hr | 8,000 Hr |
|---|---|---|---|---|---|---|---|---|---|
| 1 | 0.5 | 0.5 | 2.0 | 75 | Cordierite | 50 | 53 | 55 | 58 |
| 2 | 0.5 | 2.0 | 5.0 | 80 | Cordierite | 45 | 50 | 52 | 55 |
| 3 | 5 | 5 | 10 | 90 | Cordierite | 30 | 35 | 38 | 40 |
| 4 | 0.5 | none | — | 80 | Cordierite | 80 | 300 | 500 | 800 |

(Combustion of coke oven gas as fuel at an excess air ratio of 1.1, dust amount in coke oven gas is 50 mg/Nm$^3$, surface combustion load is 5,000,000 Kcal/m$^2$ · Hr)

As apparent from the above explanation, the invention can prevent any flame blow-off and back fire by thermal conductivity of burner element and continue the stable combustion within a wide combustion load range from low intensity combustion to high intensity combustion, and further can be used for a long period of time with low pressure loss without clogging by dirt and dust in air fuel mixed gas, so that the invention has an extremely large practical value by solving the problems of the prior surface combustion burners.

Although the invention has been described with a certain degree of particularity, it is understood that the present disclosure has been made only by way of example, and that numerous changes in details of construction and the combination and arrangement of parts may be resorted to without departing from the scope of the invention as hereinafter claimed.

What is claimed is:

1. A high temperature surface combustion burner, comprising a burner head having an air-fuel mixed gas supply inlet, a burner plate secured to said burner head and spaced apart from said gas supply inlet, said burner plate consisting of a ceramic porous body having an inlet side and an outlet combustion side and pores being sufficiently communicated from said inlet side to said outlet side for diffusing an air-fuel mixed gas therethrough, said ceramic porous body having more than 30% by volume of pores of 25 to 500 μm in mean pore diameter; a plurality of throughholes for diffusing the air-fuel mixed gas, each throughhole having a hydraulic diameter of 0.05–5.0 mm and substantially vertically extending with respect to the outlet combustion side of the ceramic porous body and provided in said burner plate at intervals of 2 to 30 mm, whereby substantially uniform combustion occurs on the outlet combustion side of the ceramic porous body by flowing said air-fuel mixed gas through said plurality of throughholes and through said pores.

2. A high temperature surface combustion burner as defined in claim 1, wherein the ceramic porous body contains 2 to 50% by weight of a heat-resisting inorganic fiber mixed therein, thereby forming a composite material.

3. A high temperature surface combustion burner as defined in claim 2, wherein the heat-resisting inorganic fiber comprises a ceramic fiber.

4. A high temperature surface combustion burner as defined in claim 1, wherein the diameter of said plurality of throughholes is 0.5 to 2.0 mm.

5. A surface combustion burner comprising: a burner head having an air-fuel mixed gas supply inlet, a burner element secured to said burner head and spaced apart from said gas supply inlet, said burner element having an inlet side and an outlet combustion side and consisting of a ceramic porous body with pores being sufficiently communicated from said inlet side to said outlet side for diffusing an air-fuel mixed gas therethrough, said ceramic porous body having 75 to 95% total volume of communicated pores having a mean pore diameter of 0.5 to 5.0 mm; and a plurality of throughholes for diffusing the air-fuel mixed gas, each throughhole having a hydraulic diameter of 0.5–5.0 mm and substantially vertically extending with respect to the outlet combustion side of the burner element and provided in said burner element at intervals of 2 to 30 mm, whereby substantially uniform combustion occurs on the outlet combustion side of the burner element by flowing said air-fuel mixed gas through said plurality of throughholes and through said pores.

* * * * *